US005772425A

United States Patent [19]

Henderson

[11] Patent Number: 5,772,425

[45] Date of Patent: Jun. 30, 1998

[54] DEVICE FOR PREVENTING FLAREUP IN LIQUID FUEL BURNERS BY CONTAINING SUMP VAPORS

[76] Inventor: Richard W. Henderson, P.O. Box 12681, Florence, S.C. 29504

[21] Appl. No.: 684,132

[22] Filed: Jul. 19, 1996

[51] Int. Cl.[6] ..... F23D 3/02

[52] U.S. Cl. ..... 431/319; 126/96

[58] Field of Search ..... 431/319; 126/96

[56] References Cited

U.S. PATENT DOCUMENTS

| | | | |
|---|---|---|---|
| 1,392,187 | 9/1921 | Mahan | 137/405 |
| 1,623,161 | 4/1927 | Buerger | 137/405 |
| 1,706,704 | 3/1929 | Phillips | 137/405 |
| 1,725,538 | 8/1929 | Remnsnider | 137/405 |
| 2,165,162 | 7/1939 | Thornton | 431/117 |
| 3,169,519 | 2/1965 | Aizawa . | |
| 3,501,252 | 3/1970 | Richardson . | |
| 4,363,620 | 12/1982 | Nakamura . | |
| 4,550,709 | 11/1985 | Nakamura et al. | 126/96 |
| 4,610,239 | 9/1986 | Nakamura et al. | 126/96 |
| 4,664,095 | 5/1987 | Takahashi . | |
| 4,797,088 | 1/1989 | Nakamura . | |
| 4,805,589 | 2/1989 | Nakanishi et al. | 126/96 |
| 4,872,831 | 10/1989 | Fujimoto . | |
| 5,080,578 | 1/1992 | Josephs . | |
| 5,165,883 | 11/1992 | Van Bemmel . | |
| 5,338,185 | 8/1994 | Henderson et al. | 431/34 |
| 5,409,370 | 4/1995 | Henderson | 431/2 |
| 5,456,595 | 10/1995 | Henderson . | |

FOREIGN PATENT DOCUMENTS

| | | | |
|---|---|---|---|
| 572552 | 11/1958 | Belgium | 126/96 |
| 1205018 | 9/1970 | United Kingdom . | |

OTHER PUBLICATIONS

Richard W. Henderson and George R. Lightsey, "Kerosene Heater Fires: Barometric Type", *Fire Marshals Bulletin* (87–5), pp. 8–10, Nov. 1987.

Richard W. Henderson and George R. Lightsey, "Kerosene Heater Fires: Barometric Type", *The National Fire and Arson Report,* vol. 6(1), pp. 2–4 (1988).

Richard W. Henderson, "Barometric Kerosene Heaters", *Fire and Arson Investigator* vol. 39(3), pp. 26–27 (1989).

John J. Lentini, "Gasoline and Kerosene Don't Mix–At Least, Not in Kerosene Heaters", *Fire Journal,* vol. 83(4), pp. 13, 86 (1989) (Jul.–Aug.).

Richard W. Henderson and George R. Lightsey, "An Anti–Flareup Device for Barometric Kerosene Heaters", *Fire and Arson Investigator,* vol.45(2), 8(1994).

*Primary Examiner*—Carroll B. Dority
*Attorney, Agent, or Firm*—David Pressman

[57] ABSTRACT

A safety device for preventing uncontrolled burning in wick-fed liquid fuel burners of the type where a removable tank (60) feeds a fuel chamber (40), which supplies the fuel to a wick (54) via a sump opening in the upper surface of chamber (40). A gasket (76) contains vapors present in the sump area when the tank (60) is seated in the sump opening. When the tank (60) is removed from the sump opening, a plate (84) moves upward due to the action of a spring (82) and contains vapors in the sump area.

8 Claims, 2 Drawing Sheets

DEVICE FOR PREVENTING FLAREUP IN LIQUID FUEL BURNERS BY CONTAINING SUMP VAPORS

BACKGROUND—CROSS-REFERENCE TO RELATED APPLICATIONS

This invention is an improvement over the inventions of several earlier applications, to-wit: Ser. No. 08/130,290, filed 1993 Oct. 4, now U.S. Pat. No. 5,338,185, granted 1994 Aug. 16, in the names of Richard W. Henderson and George R. Lightsey; Ser. No. 08/247,925, filed 1994 May 23, now U.S. Pat. No. 5,456,595, granted 1995 Oct. 10, in the name of Richard W. Henderson; Ser. No. 08/297,048, filed 1994 Sep. 30, now U.S. Pat. No. 5,409,370, granted 1995 Apr. 25, in the name of Richard W. Henderson; Ser. No. 08/365,804, filed 1994 Dec. 29, in the name of Richard W. Henderson; now U.S. Pat. No. 5,549,470; Ser. No. 08/514,583, filed 1995 Aug. 14, in the name of Richard W. Henderson; now U.S. Pat. No. 5,662,468 Ser. No. 08/559,922, filed 1995 Nov. 17, in the names of Richard W. Henderson and Samuel R. Henderson; now U.S. Pat. No. 5,551,865; and Ser. No. 08/684,131, filed Jul. 19, 1996, in the name of Richard W. Henderson.

BACKGROUND—FIELD OF INVENTION

This invention relates to safety devices, specifically to a mechanism for prevention of flareup in barometric-type wick-fed liquid fuel burners.

BACKGROUND—DISCUSSION OF PRIOR ART

In wick-fed liquid fuel burners, such as kerosene heaters, liquid fuel from a fuel chamber is supplied to a wick which is exposed to the oxygen of the atmosphere. Once the wick has been ignited, flame intensity and heat generation are controlled by adjusting the length of the wick exposed within a wick-receiving combustion chamber.

A common type of kerosene heater is the barometric style, in which gravity causes liquid fuel to be delivered to a horizontal fuel chamber from a vertically-oriented, removable tank inserted into a mating well, or sump, in the top surface of the fuel chamber. The flow of fuel from the removable tank into the fuel chamber is governed by a barometric valve in the cap on the removable tank, which, in normal operation, maintains the level of the fuel in the fuel chamber at the level of the barometric valve. A partial vacuum above the fuel in the removable tank prevents the fuel from flowing into the fuel chamber until the fuel level in the fuel chamber drops below the barometric valve, which allows air to enter the removable tank. As air enters the removable tank through the barometric valve, fuel in the removable tank flows into the fuel chamber until its level in the fuel chamber rises and covers the barometric valve in the removable tank cap, causing fuel flow from the removable tank to cease.

The barometric valve consists of a spring-loaded plunger, which has an enlarged head at one end. When the removable tank is inserted into the fuel chamber, the plunger head contacts a pin located in the fuel chamber, which pushes the plunger back, allowing the fuel in the removable tank to be in fluid communication with the fuel chamber.

When the tank is removed, the action of the spring on the plunger head forces it against the opening in the tank cap, sealing the opening and preventing fuel from leaving the tank. The capacity of the removable tank is typically about four to five liters (four to five quarts), while the fuel chamber can hold a maximum of about two liters (two quarts).

Various improvements have been made to such burners which make them safer to operate. For example, tip-over shut-off mechanisms, manual shut-off devices, and low-level $O_2$ detectors have been employed. However, these burners continue to cause fires that result in death, injury, and property loss. These fires are caused, because, when high-volatility fuels are present in the burner, under certain conditions, vapors from the sump area can be ignited by the wick flame, and in other cases, fuel can overflow the fuel chamber. When the overflowing fuel ignites, the result is an uncontrolled fire, or flareup.

The most common reason for fuel overflow is the inadvertent use of fuels with high vapor pressures. Examples of such fuels are gasoline, naphtha, and inferior kerosene, which has a low flash point. In a barometric heater, overflow of fuel from the fuel chamber can occur if the partial vacuum in the removable tank is lost. As the temperature of the heater and its surroundings increases, the vapor pressure of the fuel in the removable tank increases and, under certain conditions, allows fuel to escape from the removable tank at a rate greater than the rate of burning of the fuel. Should this process continue, the fuel chamber will overflow, since the removable tank holds about two to three liters more than the capacity of the fuel chamber. When the fuel chamber overflows, the fuel spills onto the top of the fuel chamber, and can then ignite, causing an uncontrolled fire. A second way that the partial vacuum in the barometric heater's removable tank can be lost is by air entering the removable tank due to compromise of its integrity.

There are safety devices that drop the wick down, thereby extinguishing the flame, if the burner tips over or experiences excessive vibration, or if abnormal combustion is detected. Other safety devices detect high levels of $CO_2$ and low levels of $O_2$ in the vicinity of the heater, and use these to control burning rates. Still others regulate the position of the wick during the ignition and extinguishing operations of the heater to prevent excessive flaming during these operations. Examples are shown in U.S. Pat. No. 4,363,620, issued Dec. 14, 1982 to Nakamura; 4,872,831, issued Oct. 10, 1989 to Fujimoto; 4,797,088, issued Jan. 10, 1989 to Nakamura; and 5,165,883, issued Nov. 24, 1992 to Van Bemmel. However, not only do these devices fail to prevent flareup, they are ineffective in stopping flareup after its onset. In some cases, the safety devices require the use of electrical power and electronic circuitry for actuation, and would increase the cost of the burners significantly, without rectifying the flareup problem.

It has been suggested in two publications ("Kerosene Heater Fires: Barometric Type," R. Henderson et al., *Fire Marshals Bulletin* (*National Fire Protection Association*), Vol. 87–5, p. 8 (1987); "Barometric Kerosene Heaters," R. Henderson, *Fire and Arson Investigator*(International) Association of Arson Investigators), Vol. 39, No. 3, p. 26(1989) to make the size of the removable tank of barometric kerosene heaters comparable in volume to that of the fuel chamber so that flooding of the fuel chamber will not occur. To implement this suggestion, either the capacity of the removable tank must be reduced, or alternatively, that of the fuel chamber must be increased. However, reducing the capacity of the removable tank will reduce the burn time accordingly, and possibly affect the marketability of the heaters. Increasing the capacity of the fuel chamber will require that new tanks be designed and implemented and could increase the size of the burner to an unacceptable level.

Also, it has been suggested that a float device be introduced into the fuel chamber to be used to activate the automatic wick extinguishing mechanism, and a sight gauge be present to show dangerous fuel levels in the fuel chamber. Introduction of such a float device would also require that the fuel chamber be redesigned, as discussed above. Although some burners have sight gauges in the fuel chamber, the sight gauges are used only to indicate whether or not fuel is present, not when dangerous fuel levels are present in the fuel chamber.

In addition it was proposed that a tank block-out device be installed. In this, a float in the fuel chamber pushes a pin that moves if the removable tank is withdrawn from the heater. Once again, such a device would require a redesigning of the fuel chamber and insertion of moving parts inside a somewhat restricted space.

U.S. Pat. No. 5,080,578, issued Jan. 14, 1992 to Josephs, claims that its device controls flareup in wick-fed liquid fuel burners by a) cutting off the flow of fuel to the wick in response to excessive heat by blocking a fuel line, and b) withdrawing the wick into the wick chamber when sensing excessive heat. However, Josephs' device has several disadvantages:

a) Excessive heat must be generated near the sensors before the flow of fuel is interrupted, or the wick is withdrawn. Therefore, since flareup is not prevented, the device only limits the spread of excessive flames after flareup has already occurred.

b) Excessive heat sensing devices must be near the area where uncontrolled burning is taking place due to overflow of fuel. Often the path that the overflowing fuel takes is random and flareup may not initially occur near the heat sensors.

c) The device is not applicable to barometric liquid fuel burners—the most common wick-fed liquid fuel burners in use—because these burners do not have fuel lines.

d) From the onset of flareup in wick-fed liquid fuel burners, fire is present outside the wick; therefore, retracting the wick does not affect the flareup process.

The device of the above-referenced related patent of Henderson and Lightsey consists, in part, of an excess fuel containment compartment below the level of the fuel chamber. It prevents flareup by activating a wick-extinguishing mechanism when the presence of excess fuel is detected in the fuel chamber. While this device has much merit, to be effective it requires activation of a second mechanism, that is, an automatic wick extinguisher. Should that mechanism fail to respond, due to tar buildup on the wick or a mechanical problem, flareup may still occur in some situations.

The device of the first above-referenced related patent of Henderson prevents flareup by lifting the removable tank when excess fuel is present in the fuel chamber, thereby shutting off the barometric valve and stopping fuel flow from the removable tank. For this device to work, it is necessary to provide a spring to lift the removable tank and its contents (liquid fuel), the total weight of which can be up to some five kilograms (ten pounds). Accordingly, should the spring lose strength, or should the removable tank become hindered in its upward movement, this device may not be able to prevent flareup in some situations.

The device of the second above-referenced related patent of Henderson prevents flareup by dropping the pin which holds open the barometric valve in the removable tank cap, thereby closing the valve and stopping fuel flow into the fuel chamber. Should the valve not close properly, or should some other mechanical malfunction occur, this device may not prevent flareup in some situations.

The device of the third above-referenced related patent application of Henderson, Ser. No. 08/365,804, prevents flareup by providing a thermal barrier between the combustion cylinder and the removable tank, which helps lower the temperature of the removable tank so that fuel vapor pressures do not become excessive. In addition, it includes a warning gauge that alerts the user to the dangerous condition of the burner when excess fuel is present in the fuel chamber. It also provides an excess fuel containment system that can hold the entire contents of the removable tank should all the fuel be released rapidly.

This system consists, in part, of a fuel containment sump, which extends upward from the top of the fuel chamber, and which surrounds the removable tank, but which does not have a closure at its top. This device has much merit in that it is effective without involving any moving parts for its operation. However, since the fuel containment sump is open at the top, fumes can escape around the tank and may be ignited by the wick flame. Also, should the removable tank be filled and inserted into the sump when excess fuel is already present in the fuel chamber, an additional charge of fuel may be introduced into the fuel containment system. The additional fuel may cause overflow of the fuel chamber, which could result in flareup.

The device of the fourth above-referenced related patent application of Henderson, Ser. No. 08/514,583, prevents flareup by containing fumes in the vicinity of the removable tank and by providing (a) a closure at the top of the compartment housing the removable tank, and (b) a block-out mechanism for the removable tank should excess fuel be present in the fuel chamber. Although this device also has much merit, it requires the introduction of a tank block-out mechanism in the sump in a somewhat restricted space.

The device of the fifth above-referenced related patent application of Henderson, Ser. No. 08/, acts to prevent flareup by providing a float in the fuel chamber, which float rises in response to the presence of excess fuel in the fuel chamber. As the float rises, it moves a member which obturates an opening from the sump to the chamber, causing the opening into the fuel chamber to be closed. Should the float fail to respond, or if the opening does not seal properly, excess fuel will continue to flow into the chamber, which may result in flareup.

The device of the first above-referenced related patent application of Henderson and Henderson, Ser. No. 08/559,922, now U.S. Pat. No. 5,551,865, employs a thermocouple/solenoid/lever system, which lever must be engaged until the wick flame is established sufficiently such that the solenoid can maintain the position of the lever so that it does not actuate the automatic wick extinguishing mechanism. Should excess fuel enter the fuel chamber, a float causes the thermocouple/solenoid circuit to open, which releases the lever, actuating the wick extinguishing mechanism. This device has the advantage that there is a self-test of the system each time the burner is operated. On the other hand, the device requires electrical circuitry and components for its operation. Also, should the wick extinguishing mechanism fail to operate, flareup may result.

OBJECTS AND ADVANTAGES

Accordingly, several objects and advantages of the present invention are to provide an improved and safer wick-fed, barometric, liquid fuel burner, to provide such a burner with a safety device which does not require the reduction in capacity of the removable fuel tank, does not require the redesigning of the fuel chamber to increase its capacity, does not require electrical power or electronic circuitry, does not require the presence of excessive heat for its actuation, is applicable to kerosene heaters that do not have fuel lines, and provides for the containment of fuel vapors in the sump area, without requiring any significant modification of the burner.

In addition, the present burner is quite simple in design and inexpensive to incorporate, does not have any substantially increased weight, will save lives and property, will make barometric liquid fuel burners easier to market because of added safety value, and will likely reduce the number of expensive lawsuits prompted by injury, loss of life, and property damage.

Still further objects and advantages will become apparent from a consideration of the ensuing description and drawings.

DRAWING REFERENCE NUMERALS

Figure 1:
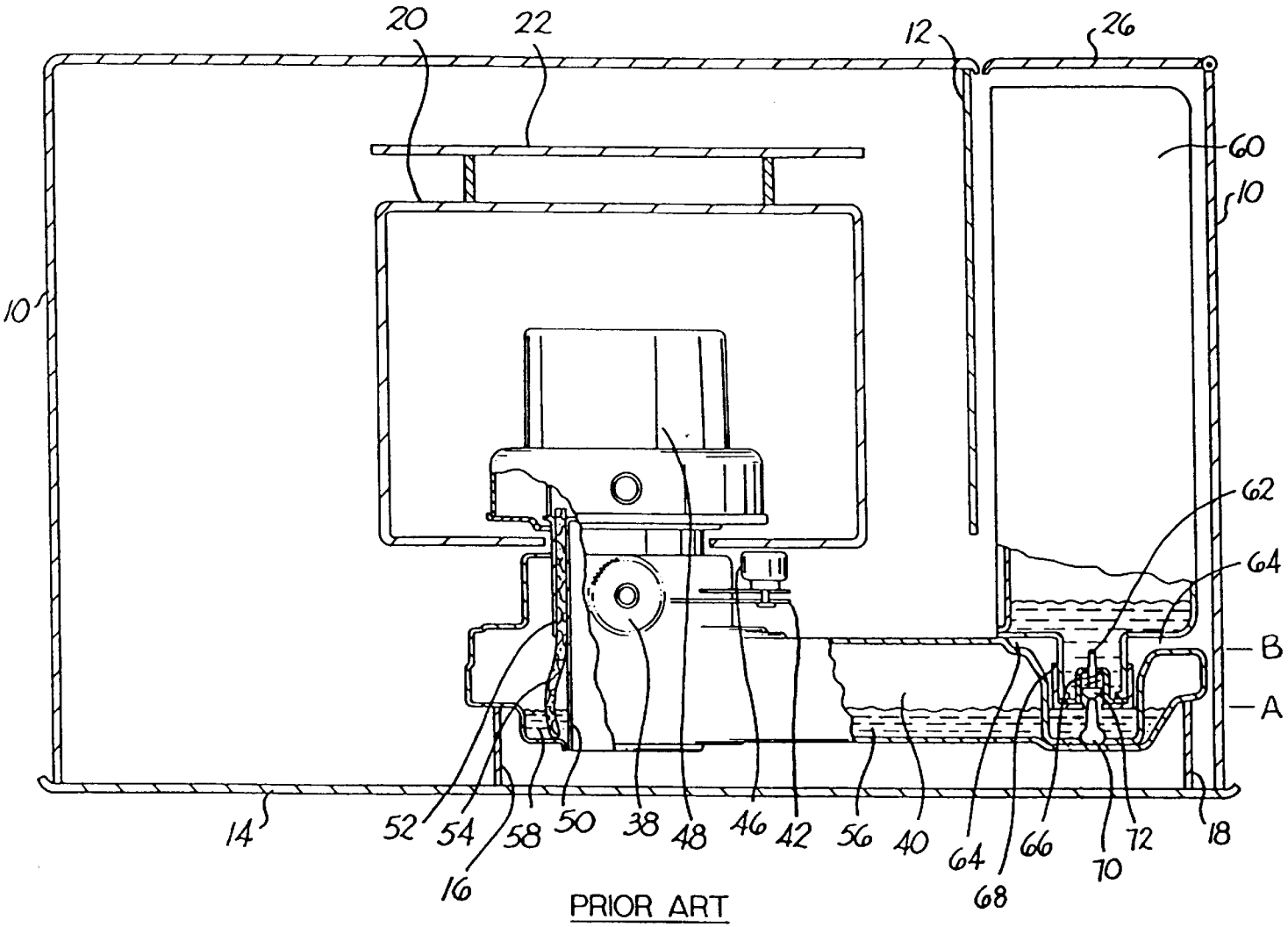
PRIOR ART FIG. 1
FIG. 1 is a side sectional view of a prior-art, wick-fed, barometric liquid fuel burner with an automatic wick extinguishing unit that can be activated by a vibration-sensing weight, and a thermal barrier system that acts to isolate the removable tank from the heat of the combustion process

10 Cabinet
12 Tank guide
14 Basetray
16 Support
18 Support
20 Reflector
22 Heat shield
24 Cabinet opening
26 Lid
28 Lid opening
30 Cabinet opening
32 Support
34 Air diverter
36 Support
38 Wick gear
40 Fuel chamber
42 Automatic wick extinguishing unit
44 Frame member
46 Vibration-sensing weight
48 Combustion cylinder
50 Inner wick guide
52 Outer wick guide
54 Wick
56 Fuel
58 Wick fuel supply reservoir
60 Removable fuel tank
60A Sump
62 Plunger
64 Opening
66 Plunger spring
68 Tank cap
70 Pin
72 Plunger head
74 Orifice
76 Gasket
78 Guide
80 Lip
82 Spring
84 Plate
86 Raised area
88 Orifice
90 Opening
92 Orifice
94 Stop
A Normal fuel level
B Flooded fuel level

SUMMARY

In accordance with the present invention, an anti-flareup safety device for wick-fed, barometric liquid fuel burners contains any vapors present in the sump, thereby preventing these vapors from migrating to the wick flame, where they could ignite. The safety device includes a gasket that is located between the top of fuel chamber and the bottom of the removable tank and which surrounds the opening where the tank cap enters the opening the top of the fuel chamber.

DESCRIPTION—CONVENTIONAL HEATER STRUCTURE—FIG. 1

FIG.1 is side sectional view of a conventional wicked-fed barometric liquid-fuel burner (as described supra) that operates by burning a liquid fuel, such as kerosene. The burner is a wicked-fed type with a combustion cylinder 48 and is constructed in a manner widely known in the art. One manufacturer of the burner of FIG. 1 is *Toyotomi of Japan*, and such manufacturer sells such burners under the trademark Envirotemp by Kero-Sun.

In normal operation fuel is delivered from a removable fuel tank 60 to a horizontal fuel chamber 40 through an orifice in a tank cap 68 on tank 60. Tank 60 is held in a vertical position by tank guide 12 in cabinet 10 in accordance with the common practice of the industry. Cap 68, which is attached to the neck of tank 60, is inserted into a mating well, or sump, in the top surface of chamber 40, also the common practice in the industry.

When the fuel level in chamber 40 drops below level A due to fuel consumption by wick 54, air will bubble into tank 60 through orifice 74 in tank cap 68, and fuel (e.g., kerosene) will flow from tank 60 into chamber 40 until the level in chamber 40 reaches level A. A partial vacuum above the fuel in tank 60 maintains the fuel in tank 60 above level A until all of the fuel has been discharged from tank 60. Fuel 56, which is in fluid communication with wick 54, migrates by capillary action up wick 54 and is burned inside combustion cylinder 48, which generally consists of inner metal cylinders and an outer glass cylinder. Cylinder 48 provides a surface for the burning of the fuel, and radiates heat and some light. The flame is not shown, but is seen as a red glow in cylinder 48, above the wick.

Wick 54, cylindrical in shape and shown in a partial cross-sectional view, can be moved up or down by rotating a wick gear 38. Wick 54, wick guides 50 and 52, combustion cylinder 48, wick fuel supply reservoir 58, and vibration-sensing weight 46 in FIG. 1 are circular in shape when seen from above, whereas compartment 40 is generally rectangular. Removable fuel tank 60 is most commonly rectangular in shape as viewed from above, but various other shapes are also found, such as triangular. Tank cap 68 is cylindrical in shape, and is threaded to allow attachment to tank 60.

The fuel burner has an automatic wick extinguishing unit 42, which includes a vibration-sensing weight 46. If the burner is vibrated excessively, unit 42 disengages wick gear 38, which lowers wick 54, extinguishing the flame, or actuates any other wick extinguishing mechanism (not shown).

OPERATION AND DANGER OF FLAREUP WITH CONVENTIONAL BURNER—FIG. 1

If the partial vacuum in tank 60 is lost, the barometric system described earlier no longer regulates fuel flow from tank 60. The partial vacuum may be lost by compromise of the integrity of tank 60, or by the presence of a high vapor pressure in tank 60, e.g., due to heating of tank 60. Most flareup incidents occur when a high-volatility fuel is inadvertently introduced into tank 60—most commonly, gasoline or gasoline-contaminated fuel. As a result, excessive fuel will flow into chamber 40. Since the capacity of tank 60 is about two liters greater than that of chamber 40, chamber 40 will not be able to contain all of the fuel from tank 60, if any significant amount of fuel is present in tank 60. As a result, fuel fills chamber 40 and when it reaches level B, overflows via opening 64 between tank 60 and the top of chamber 40.

The fuel spreads over the fuel chamber's surface and to other areas in the burner. The flooded fuel will ignite because the vapors from the leaked fuel are drawn by air movement toward the wick flame (not shown) in cylinder 48, which is of sufficient temperature to ignite these fumes. As a result, there will be flames in and around tank 60, causing the pressure inside tank 60 to increase dramatically, driving more fuel out of tank 60, which further increases the amount of escaped fuel, and accordingly increases the severity of the flareup.

The flareup incidents involving high-volatility fuels do not occur immediately after the burners are lit, but usually after an induction period of one or more hours. There is a delay because these burners are utilized for heating purposes at cooler ambient temperatures. At such temperatures, even the high-volatility fuels have vapor pressures low enough that the partial vacuum above the liquid in tank 60 is adequate to maintain the column of fuel in the tank, which requires a pressure differential of only approximately 3 kPa (0.4 psi) for the 36 cm (14 in) height typical of removable tanks.

For example, at 21° C. (70° F.) the vapor pressure of the most volatile class of gasoline, Class E, is on the order of 69 kPa (10 psi). Since ambient pressure is around 101 kPa (14.7 psi), a column of gasoline nearly 5 m (15 ft) high could be maintained at such a pressure differential. However, should the temperature of the gasoline reach 38° C. (100° F.)—the approximate boiling point of gasoline—its vapor pressure will increase to about 101 kPa (14.7 psi), and the fuel will flow out of the removable tank and into the fuel chamber in an uncontrolled manner. This will circumvent the normal operation of the barometric valve. The increase in temperature of the air space in the removable tank during operation of the burner is not a significant factor in the loss of the partial vacuum in the removable tank. This is because the temperature increases are not rapid enough to overcome the normal action of the barometric valve in controlling fuel flow from tank 60 as fuel is consumed by the wick.

Unless the burner is in a very low temperature environment, the temperature of the removable tank will typically exceed 38° C. (100° F.) during operation of the burner. The removable tank achieves such temperatures due to its proximity, about 13 cm (5 in), to the combustion process, which reaches temperatures in excess of 850° C. (160° F.). During operation of the burner, heat is transferred by radiation, convection, and conduction processes from the combustion cylinder to the removable tank.

The typical flareup scenario in such burners is as follows: Initially, the fuel in the removable tank is at a low enough temperature so that its vapor pressure is insufficient to allow liquid to flow from the removable tank beyond that allowed by the barometric valve. At this point, the liquid level in the fuel chamber will be maintained at the level of the barometric valve, which allows fuel to flow from the removable tank into the fuel chamber only as fuel is consumed by the wick. The temperature of the removable tank, as well as the fuel inside it, increases as thermal equilibrium is established in the burner, causing the vapor pressure of the fuel to increase. Then the increased vapor pressure of the fuel compromises the partial vacuum inside the removable tank, allowing fuel in the removable tank to flow into the fuel chamber in an uncontrolled manner. Since the capacity of the removable tank (4–5 liters) far exceeds that of the fuel chamber (1–2 liters), the fuel chamber fills and overflows. The vapors from the spilled fuel ignite and flareup ensues.

There is a second mechanism for flareup when high-volatility fuels are present. Vapors present in the sump area can be drawn to the wick flame by air currents, where they are ignited.

With the exception of the Henderson and Lightsey device, and the Henderson tank-lift, pin-drop, thermal barrier/fuel containment, vapor containment/tank-block and float/fuel shutoff devices, and the Henderson and Henderson device, prior-art safety devices do not prevent flareup, but rather detect evidence that flareup has begun, and then trigger an automatic wick extinguishing unit, which acts to extinguish the flame on the wick. However, by the time flareup has begun, there are flames outside the wick area and extinguishment of the wick flame does not affect the progression of flareup. The flames are present where fuel has flooded, and the increasing amounts of fuel being discharged from the removable tank further increase the magnitude of the flareup incident, as described earlier.

The Henderson and Lightsey device is designed to extinguish the flame on the wick prior to flareup. However, if the wick shutoff mechanism fails to operate when activated as a result of the wick becoming encrusted, or if there is some other problem with the wick shut-off mechanism, this device may not be able to prevent flareup. The Henderson tank-lift and pin-drop devices are designed to shut off fuel flow from the removable tank to the fuel chamber by separating the removable tank from the pin that opens the barometric device in the cap on the removable tank cap. However, these two Henderson devices have one feature in common; should they not operate properly to stop fuel flow from the removable tank, the fuel chamber may overflow and flareup may result.

The Henderson thermal barrier/fuel containment device is a very simple and effective device; however, fuel vapors in the vicinity of the removable tank can migrate over the walls of the fuel containment sump, which surrounds the removable tank, and may be drawn to the wick flame by the air movement in the burner, where they could be ignited. Also, should excess fuel already be present in the fuel chamber, and additional fuel be introduced via the removable tank, it is possible that the fuel in the removable tank could be lost faster than the wick flame could consume it, which could result in flooding of the fuel containment system, and possibly flareup. The Henderson vapor containment/tank block mechanism is quite simple and effective. However, in order to contain an amount of fuel equal to the full capacity of the removable tank, this device requires either a) the incorporation of two additional compartments (beyond the fuel chamber), or b) the incorporation of one additional compartment, and an increase in the capacity of the fuel chamber.

The Henderson and Henderson thermocouple/solenoid device provides a self-test of the system each time the burner is operated. However, it requires incorporation of electrical circuits and components, and depends upon the proper functioning of the automatic wick shutoff mechanism. The Henderson float/fuel shutoff device is designed to block fuel flow into the fuel chamber when excess fuel is lost from the removable tank. Should the float not respond, or if the opening for fuel flow does not close properly, flareup may result.

Thus, prior-art safety devices, such as those which monitor excessive vibration of the burner, which detect high levels of $CO_2$ and low levels of $O_2$, which detect abnormal combustion, and which regulate the position of the wick to prevent excessive flaming, are ineffective in preventing flareup. The safety device described in the Josephs patent, supra, does not prevent flareup, but rather provides a wick-drop mechanism, and cuts off fuel flow through a fuel line after the onset of flareup. Since the wick-fed barometric liquid fuel burners in common use do not utilize a fuel line, Josephs' device is not applicable to them.

The Henderson and Lightsey, and the Henderson tank-lift, pin-drop, and float/fuel shutoff devices are designed to prevent flareup, but should they not operate properly, flooding of the fuel chamber may occur, and flareup may result. In the case of the Henderson thermal barrier/fuel containment device, vapors around the removable tank may escape and he ignited by the wick flame. Also, should the fuel containment system already contain excess fuel, flooding may occur if the removable tank is inserted with additional fuel and the loss of fuel from that tank is faster than the wick flame can consume it. To be most effective, the Henderson vapor containment/tank block device requires either the incorporation of two separate compartments as an adjunct to the fuel chamber, or an increase in the capacity of the fuel chamber and incorporation of one additional compartment. The Henderson and Henderson thermocouple/solenoid device is designed to actuate the wick shutoff mechanism. However, should that mechanism fail to respond, e.g., due to the wick becoming encrusted or some other problem with the wick shutoff system, flareup may result.

Figure 3:
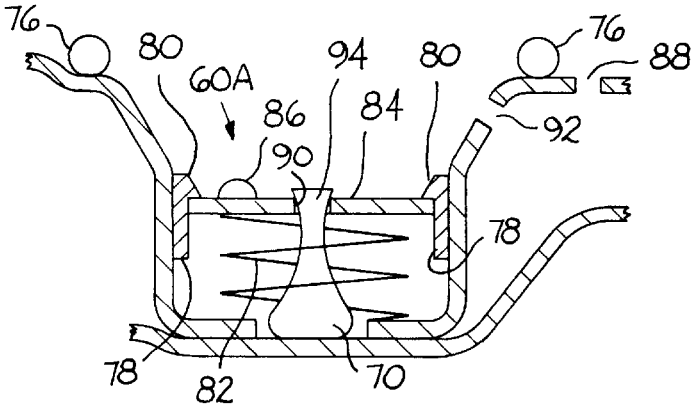
FIG. 3 is a side sectional view of the sump area of a wick-fed, barometric liquid fuel burner with an anti-flareup safety device in accordance with the preferred embodiment of the present invention.
Figure 2:
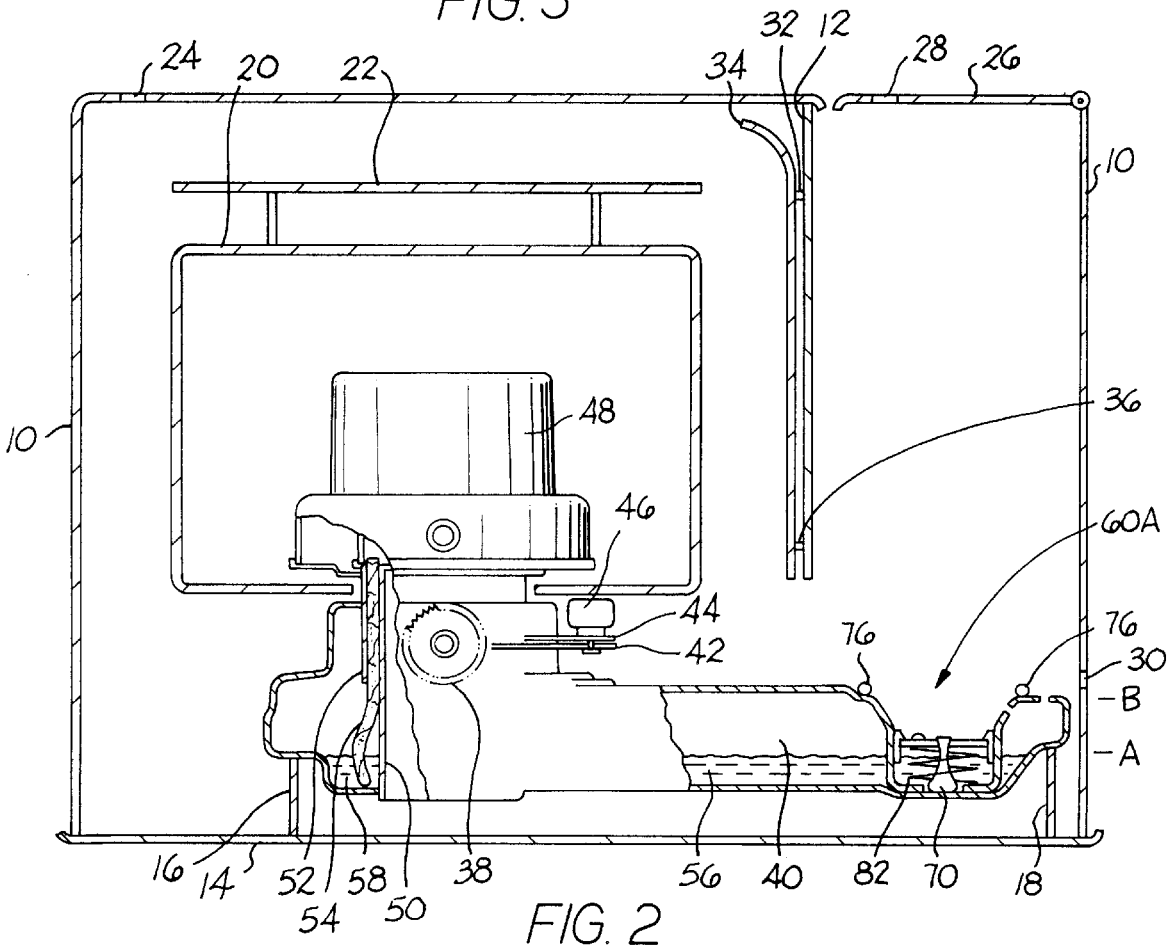
FIG. 2 is a side sectional view of a wick-fed, barometric liquid fuel burner with an anti-flareup safety device in preferred embodiment of the present invention.

DESCRIPTION OF INVENTIVE ANTI-FLAREUP DEVICE—FIGS. 2 and 3

An improvement over the earlier anti-flareup devices which overcomes the above problems is illustrated by the wicked-fed barometric liquid fuel burner of FIGS. 2 and 3. It operates by providing a vapor containment system that contains fuel vapors in the sump area. It includes the following conventional elements: a cabinet 10, a tank guide 12, a basetray 14, a reflector 20, a heat shield 22, a lid 26, a fuel chamber 40, a wick 54, a wick gear 38, a combustion cylinder 48, a vibration-sensing weight 46, and an automatic wick extinguishing unit 42. The burner of FIGS. 2 and 3 also includes certain elements of the Henderson thermal barrier device, specifically, an air diverter 34, and openings 24, 28, and 30 in cabinet 10. The removable tank has been omitted for the sake of clarity but is shown at 60 in FIG. 1. Tank 60 is inserted into a well or sump 60A (FIGS. 2 and 3) formed in the top of chamber 40. Pin 70 is secured in a vertical orientation at the bottom of sump 60. As tank 60 is lowered into cabinet 10, pin 70 contacts plunger head 72, forcing it backward into cap 68, thereby allowing fuel in tank 60 to flow into sump 60A.

In addition, the burner of FIGS. 2 and 3 includes additional elements which constitute a preferred embodiment of the present inventive anti-flareup safety device. A gasket 76 is located on top of chamber 40, around the inner side of the top of well 60A. Gasket 76 extends inward from the side of well 60A such that the inner-top edge of gasket 76 will contact the bottom of the removable tank when such tank (identical to tank 60 of FIG. 1) is inserted into well 60A. Gasket 76 is circular in cross-section and in overall shape when seen from above so that it extends completely around the inner upper periphery of well 60A where tank cap 68 resides when tank 60 is seated properly in the mating well in chamber 40. Gasket 76 is about 7.6 cm (3 in) in diameter, and is approximately 0.6 cm (0.25 in) in diameter; it extends upward around 1.1 cm (0.4 in). Gasket 76 is preferably flexible, and may be made of a plastic or rubber material (such as neoprene), metal, or other convenient material. It is adhered to well 60A by a suitable adhesive.

Also present is a guide 78, which is located in well 60A. Guide 78 is cylindrical, having an inside diameter of about 3.7 cm (1.5 in), a height of about 2.5 cm (1 in), and a wall thickness of around 0.2 cm (0.09 in), and which has its wall in a vertical orientation. Guide 78, which is preferably metal, is of sufficient diameter such that cap 68 will fit inside guide 78. The entire circumference of the top of guide 78 has a lip 80 extending radially inwardly. Lip 80, which is preferably metal, extends inwardly from guide 78 about 0.5 cm (0.2 in). Lip 80 has a triangular cross-section, as shown in FIG. 3, with its upper surface slanting down toward the center of the well and its lower surface level.

A plate 84 is located inside guide 78. Plate 84, which is preferably metal, is circular, with a diameter of approximately 3 cm (1.2 in) and a thickness of about 0.5 cm (0.2 in). The center of plate 84 has an opening 90 which has a diameter of about 0.3 cm (0.1 in). The opening is aligned such that the upper end of pin 70 extends through it, with sufficient clearance that plate 84 can be readily moved in a vertical manner without interference from pin 70. At the top of pin 70 is a stop 94, which extends horizontally above opening 90 in plate 84. Stop 94 is of sufficient diameter to close off opening 90 where plate 84 is in its uppermost position and is about 0.4 cm (0.15 in) in diameter. On the upper surface of plate 84 is a boss 86, which is located about 1 cm (0.4 in) from the perimeter of plate 84, which extends upward from plate 84 about 0.5 cm (0.2 in), and which is about 0.5 cm (0.2 in) in diameter. Plate 84, which is oriented in a horizontal position, is restricted at the top of its movement by lip 80 on guide 78.

Below plate 84 is a spring 82, the top of which contacts the bottom of plate 84, and the bottom of which contacts the bottom of well 60A. Spring 82 keeps slight tension, about 180 g (0.4 lb), on plate 84, such that plate 84 is pushed to the top of its range of movement in guide 78 when tank 60 is not present. The diameter of spring 82 is around 3.8 cm (1.5 in), and its height when not compressed is about 63 cm (2.5 in). An orifice 88 is located in the top of chamber 40 outside gasket 76 which surrounds the sump area. Orifice 88 is about 0.3 cm (0.1 in) in diameter. An orifice 92 is located in the top of chamber 40 inside gasket 76, and is about 0.3 cm (0.1 in) in diameter.

OPERATION OF INVENTIVE ANTI-FLAREUP DEVICE—FIGS. 2 and 3

After ignition of the wick, the burner components begin to increase in temperature. The hottest location in the burner components is in the vicinity of cylinder 48, especially over it. During operation of the burner, tank 60 (FIG. 1), and the fuel inside, will become warmer, causing the vapor pressure of the fuel to increase; the temperature increase is limited due to the action of air diverter 34 (FIG. 2) coupled with the cooling effect provided by openings 24, 28, and 30. As a result, even if a high-volatility fuel, such as gasoline, is present in tank 60, the vapor pressure of the fuel in tank 60 does not increase to the point that the partial vacuum above the fuel becomes sufficiently compromised so that excess fuel is lost from tank 60.

Even though the liquid fuel is contained, however, vapors from high-volatility fuels such as gasoline are quite dangerous, and can migrate to the wick flame and be ignited. The present device acts to contain any vapors present, thereby preventing ignition of those vapors, and flareup.

When tank 60 is present in the burner and inserted into the mating well, its cap 68 will push plate 84 down, causing plate 84 to move downward in response. Raised area 86 on plate 84 contacts cap 68, preventing plate 84 from sealing off the opening in the barometric valve in cap 68. Due to its weight, tank 60 will continue to move downward, until its bottom surface contacts the upper portion of gasket 76, at which point its movement will cease. Gasket 76 seals the space between tank 60 and the sides of well 60A, restricting the movement of vapors out of the sump area.

Orifice 88, in conjunction with orifice 92, permits air ingress into the sump area so that the barometric valve can operate properly. The air entering is necessary to replace the volume occupied by the fuel leaving tank 60 during the normal operation of the barometric valve. Orifices 88 and 92 are too small to allow passage of any vapors at rates that are significant enough to pose a fire hazard.

Should tank 60 be removed from the burner, spring 82 will urge plate 84 upward. Plate 84 will move upward until its perimeter contacts lip 80 on guide 78, at which point the opening around pin 70 where pin 70 penetrates plate 84 is closed off by stop 94. As a result, vapors in chamber 40 will not be able to migrate significantly out of the sump area.

ADVANTAGES

It is clear from the discussion above that the anti-flareup safety device is quite simple in construction, and can be readily incorporated in wick-fed barometric liquid fuel burners without increasing their size. Yet it will prevent flareup by providing a system that contains dangerous fuel vapors.

The present device prevents the burning of fuel outside its intended site, that being at the wick, thereby saving fuel and reducing odor. Also, the device does not require any electrical power or electronic circuitry for the prevention of flareup. The device is quite Simple, and it can readily be incorporated in contemporary burners at virtually no increase in manufacturing cost per unit.

Clearly, the device will make wick-fed, barometric liquid fuel burners safer to operate, and accordingly, will at the same time reduce the expensive lawsuits resulting from flareup incidents, and will reduce the incidence of injury, loss of life, and property damage. As a result these burners will be easier to market.

RAMIFICATIONS AND SCOPE

Those skilled in the art can now appreciate from the foregoing description that the broad teachings of the present invention can be implemented in a variety of forms. Therefore, while the safety device has been described in connection with particular examples thereof, the true scope of the invention should not be so limited since other modifications will become apparent to the skilled practitioner upon a study of the drawings, specification and following claims.

For example, the shape and composition of the safety device can be varied, so long as its function is preserved.

Although gasket 76 is shown as being situated on the top surface of the fuel chamber, it may be located in the sump area, or in some other convenient area, so long as it acts to contain fumes in the sump area. The cross-sectional shape of gasket 76 may be round, oval, flat, or other convenient shapes, so long as its function is preserved. Also, although gasket 76 is depicted as a single entity, it can be comprised of multiple components. While plate 84 is shown as being circular, it can have other shapes, so long as it acts to restrict vapor migration from the sump area when tank 60 is removed from the burner. Also, it may consist of more than one component, and may be hinged at locations along its perimeter, so long as its movement is not constricted.

Orifice 88 may be located anywhere outside gasket 76, as long as air passing through orifice 88, in conjunction with orifice 92, can access the headspace in the vicinity of the barometric valve when tank 60 is inserted into the burner. Orifices 88 and 92 may consist of multiple openings, or they may be replaced with a tube which extends from the outside of chamber 40, and outside gasket 76, to the headspace above the barometric valve. Alternatively, there may be an opening in gasket 76 to allow air ingress into the sump area, in which case orifices 88 and 92 can be eliminated.

Also, the device may be connected to or used in combination with other safety devices, such as warning gauges, tank block features, or shutoff mechanisms. Thus the scope of the invention should be determined, not by the examples given, but by the appended claims and their legal equivalents.

What is claimed is:

1. In an apparatus for preventing flareup in a liquid fuel burner of the type comprising:

(a) a removable liquid fuel tank for holding liquid fuel, (b) a fuel chamber for receiving said fuel from said tank, (c) a sump opening in said fuel chamber through which said fuel in said fuel tank is transferred to said fuel chamber, (d) a combustion cylinder having a wick, and (e) a thermal barrier for isolating said tank from the heat of said combustion chamber, (f) said fuel chamber being arranged to supply said liquid fuel from said fuel tank to said wick of said combustion chamber, the improvement comprising:

(g) a fuel vapor containment gasket that contains vapors in said sump opening when said tank is seated in said sump opening, said gasket comprising a flexible material.

2. An apparatus according to claim 1 wherein said fuel vapor containment gasket surrounds said sump opening and contacts the upper surface of said fuel chamber and the bottom of said tank.

3. An apparatus according to claim 1, further including a fuel vapor containment plate that contains vapors present in said sump opening when said tank is not seated in said sump opening.

4. An apparatus according to claim 1, further including a fuel vapor containment plate that contains vapors present in said sump opening when said tank is not seated in said sump opening, said plate having an opening inside its perimeter.

5. An apparatus according to claim 1, further including a fuel vapor containment plate that contains vapors present in said opening when said tank is not seated in said sump opening, said plate being held in position by the action of a spring.

6. An apparatus according to claim 1, further including a fuel vapor containment plate that contains vapors present in said opening when said tank is not seated in said sump opening, said plate having a protuberance on its upper surface.

7. An apparatus according to claim 1, further including an orifice for permitting air to migrate into said sump opening.

8. An apparatus according to claim 1, further including an orifice for permitting air to migrate into said sump opening, said orifice being located in said chamber.

* * * * *